United States Patent [19]

Andreadakis

[11] 4,352,040

[45] Sep. 28, 1982

[54] DISPLAY PANEL WITH ANODE AND CATHODE ELECTRODES LOCATED IN SLOTS OF BASE PLATE

[75] Inventor: Nicholas C. Andreadakis, Branchburg, N.J.

[73] Assignee: Burroughs Corporation, Detroit, Mich.

[21] Appl. No.: 167,830

[22] Filed: Jul. 14, 1980

[51] Int. Cl.[3] ..... H01J 17/49; H01J 17/16

[52] U.S. Cl. ..... 313/217; 313/220

[58] Field of Search ..... 313/217, 220

[56] References Cited

U.S. PATENT DOCUMENTS 3,665,238 5/1972 Esdonk et al. ..... 313/220

3,836,810 9/1974 Johanns et al. ..... 313/220 X 3,846,656 11/1974 Schermerhorn ..... 313/220 X 3,996,490 12/1976 Miller ..... 313/217

*Primary Examiner*—Palmer C. Demeo

*Attorney, Agent, or Firm*—Kevin R. Peterson; Robert A. Green; David G. Rasmussen

[57] ABSTRACT

The disclosure is of a display panel which contains a plate having two arrays of accurately dimensioned slots in which electrodes are disposed. The first array of shallow slots are formed in the plate by an etching process, and the second array of deeper slots are formed in the plate by an etching or grinding process. Electrodes are seated in the slots to form an array of rows and columns of cells.

3 Claims, 8 Drawing Figures

DISPLAY PANEL WITH ANODE AND CATHODE ELECTRODES LOCATED IN SLOTS OF BASE PLATE

BACKGROUND OF THE INVENTION

A recently invented display panel which comprises a dot matrix display having memory is relatively complex and includes several support plates and electrode arrays which must be prepared and assembled accurately. This panel is described and claimed in copending applications Ser. Nos. 51,313, filed June 22, 1979; and 108,805, filed Dec. 31, 1979, now U.S. Pat. No. 4,329,616.

The present invention relates to improvements in the panel, particularly in the base plate portion thereof and its preparation.

DESCRIPTION OF THE PREFERRED EMBODIMENTS

The present invention is embodied in a display panel 10 of the type described and claimed in copending applications of George E. Holz and James A. Ogle, Ser. No. 51,313, filed June 22, 1979; and Ser. No. 108,805, filed Dec. 31, 1979, both incorporated herein by reference, along with the patents and publications cited therein. These applications both describe a dot matrix memory display panel including a D.C. scanning portion and an A.C. display portion.

Figure 1:
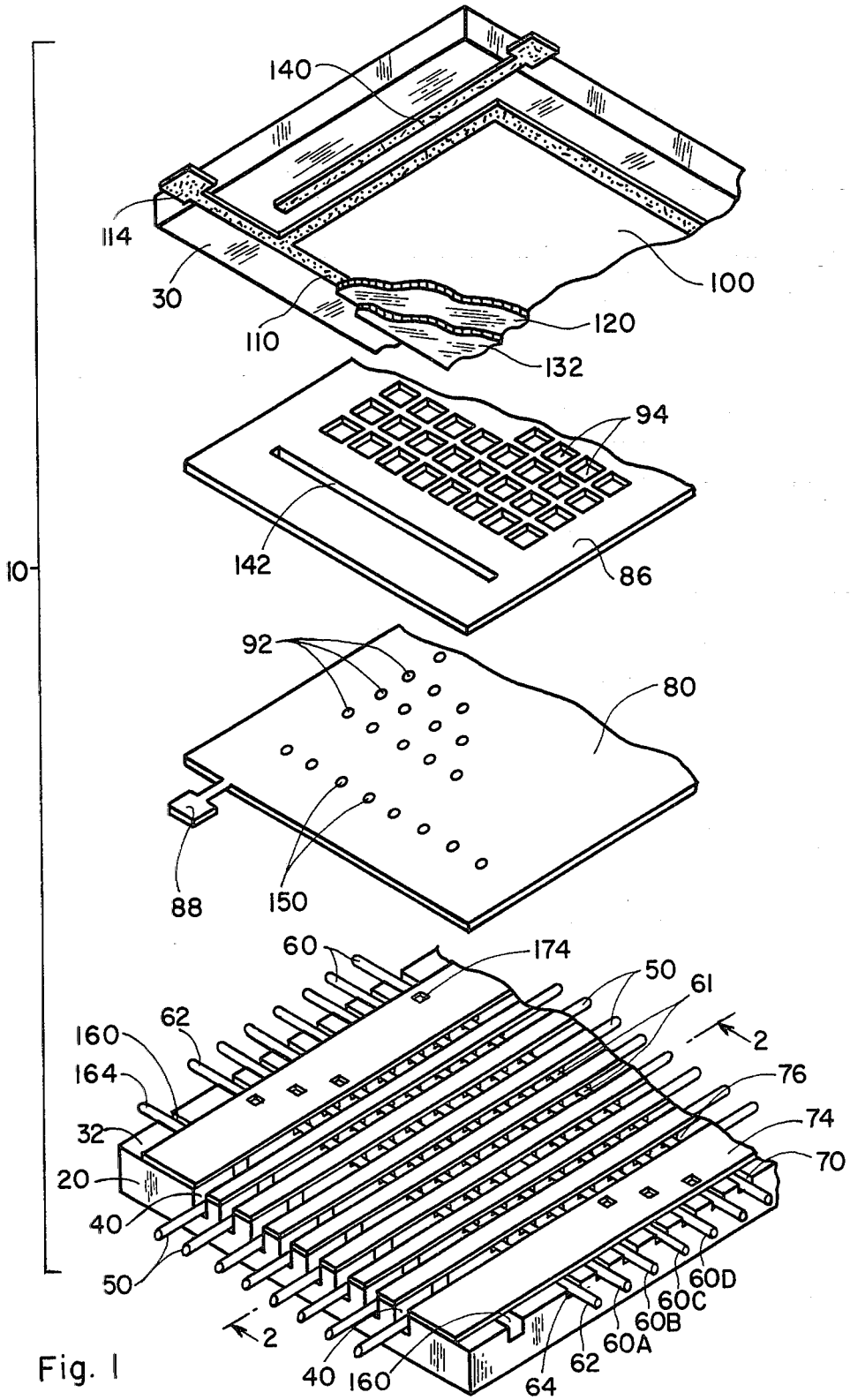
FIG. 1 is a perspective exploded view of a display panel embodying the invention.
Figure 2:
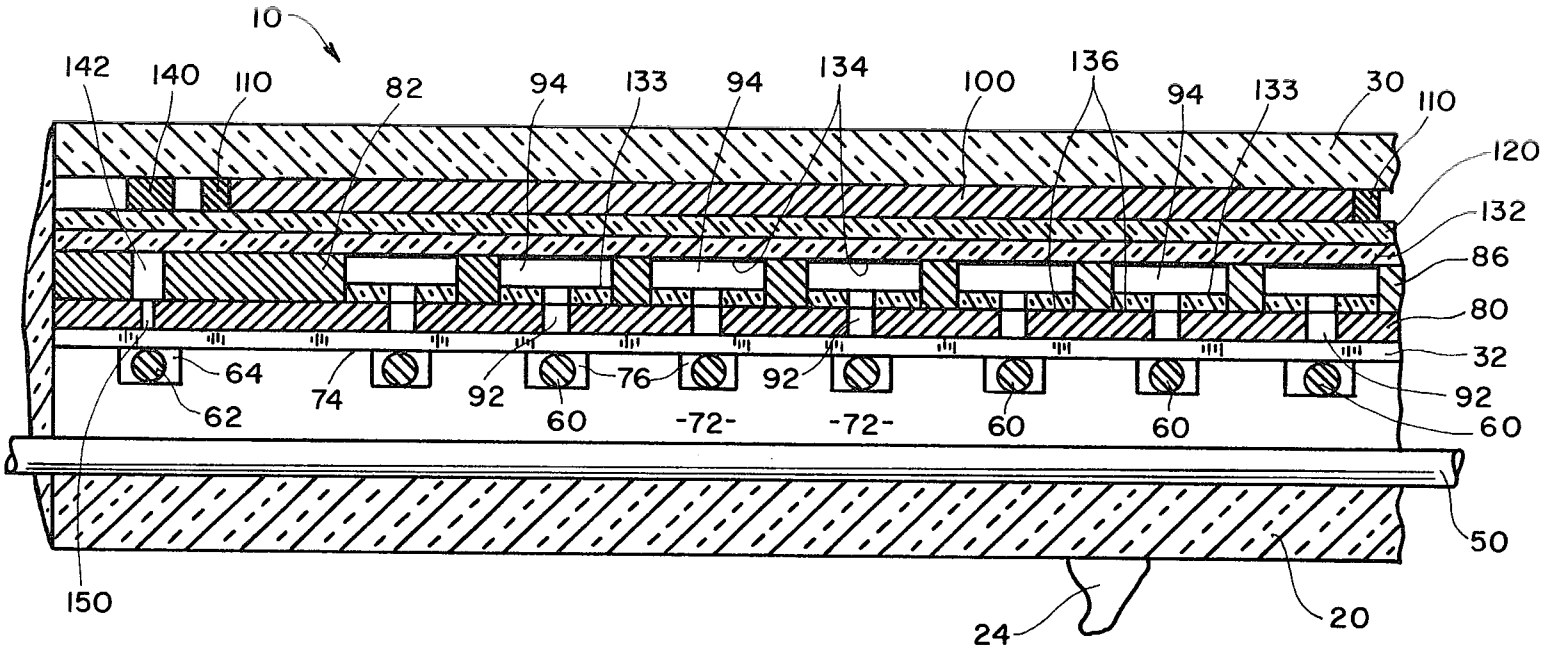
FIG. 2 is a sectional view through the panel of FIG. 1 along lines 2—2, with the panel shown assembled.

The display panel 10 includes a gas-filled envelope made up of an insulating base plate or substrate 20 and a glass face plate 30, which is shown tilted up and rotated to the left in FIG. 1 to present a view of its interior surface. These plates are hermetically sealed together, as illustrated in FIG. 2, along a closed periphery which surrounds the operating inner portion of the panel and the various gas cells provided therein. The base plate has a top surface 32, in which a plurailty of relatively deep parallel longitudinal slots 40 are formed and in each of which a scan/address anode electrode, for exaple a wire 50, is seated and secured.

A plurality of scan cathode electrodes in the form of wires 60 are seated in relatively shallow slots 70 in the top surface of the base plate. The slots 70 and scan cathodes 60 are disposed transverse to the slots 40 and scan anodes 50, and each crossing of a scan cathode 60 and a scan anode 40 defines a scanning cell 72 (FIG. 2). It can be seen that the scanning cells are arrayed in rows and columns. More specifically, the cathode portions 61, the underlying portions of anodes 50, and the intermediate gaseous regions define the scanning cells.

The scan cathodes 60A, B, C, etc., form a series of cathodes which can be energized serially in a scanning cycle, with cathode 60A being the first cathode energized in the scanning cycle.

A reset cathode electrode 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with the first cathode 60A.

In the panel 10, it is desirable that the cathodes 60, or at least the portions 61 thereof which are disposed in the scanning cells, be spaced uniformly from an electrode 80 positioned above the cathodes and described below. Thus, the cathode grooves or slots 70 must be of uniform depth. It is also desirable to provide means for preventing the spread of cathode glow from the operating portions 61 of the cathodes to the intermediate portions. These conditions may be satisfied by providing a thin slotted insulating sheet or layer 74 on the top surface of the base plate 20. The slots 76 in the sheet 74 are aligned with the anode slots 40 and overlie the portions 61 of the cathodes 60. The lower surface of the sheet 74 either touches the intermediate portions of the cathodes or is so close to these portions that cathode glow does not spread along the cathodes from one operating portion 61 to the next. Alternatively, sheet 74 can have a separate aperture for each cathode portion 61, rather than slots 76, and it can advantageously be formed as a screen printed layer, rather than a sheet.

The portions of the panel described up to this point comprise the base plate assembly. This is the D.C. portion and the scanning and addressing portion of the panel.

Adjacent to the base plate assembly is the second portion of the panel which is a quasi A.C. assembly; that is, it includes A.C. and D.C. features. This portion of the panel includes an electrode in the form of a thin metal plate 80 having an array of rows and columns of relatively small apertures 92, each overlying one of the scanning cells. The plate 80 is positioned close to cathodes 60 and may be seated on insulating sheet 74. Electrode plate 80 includes a terminal 88 for making electrical connection thereto.

Adjacent to plate 80, and preferably in contact with the upper surface thereof, is an apertured plate or layer 86 having rows and columns of apertures 94 which are considerably larger than apertures 92. The apertures 94 comprise the display cells of panel 10. The sheet 86 may be of insulating material, as shown in FIG. 2, or it may be of metal, and, if it is of metal, the plates 80 and 86 may be made in one piece, if desired and if feasible.

The quasi A.C. assembly also includes a face plate assembly which comprises face plate 30 and a large-area transparent conductive electrode 100 on the inner surface of the plate 30 together with a narrow conductor 110 of silver or the like which outlines and reinforces the electrode layer 100 to increase its conductivity. The conductor 110 includes a portion 114, to which external connection can be made. The large-area electrode 100 overlies the entire array of display cells 94 in plate 86. An insulating coating 120 of glass or the like covers electrode 100, and, if desired, a dielectric layer 132 of magnesium oxide, thorium oxide, or the like is coated on layer 120.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize cathode sputtering, a coating of the material of layer 132 should also be provided on the base or lower wall 136 of each display cell 94, such as the layer 133 shown in FIG. 2.

Panel 10 has a keep-alive arrangement which includes an A.C. electrode 140 in the form of a linear conductive film or layer of opaque metal, such as silver, provided on the inner surface of the face plate 30 adjacent to one edge of the transparent conductive electrode 100. The A.C. keep-alive electrode 140 is positioned so that it is in optimum operative relation with the column of reset cells and reset cathode 62, to which it supplies excited particles. The A.C. keep-alive electrode 140 is covered by the insulating layers 120 and 132. The plate 86 is provided with a slot 142, and a plate 80 is provided with a column of holes 150, the slot 142 overlying and being aligned with the column of holes 150, and both lie beneath and are aligned with the A.C. electrode 140. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

Figure 3:
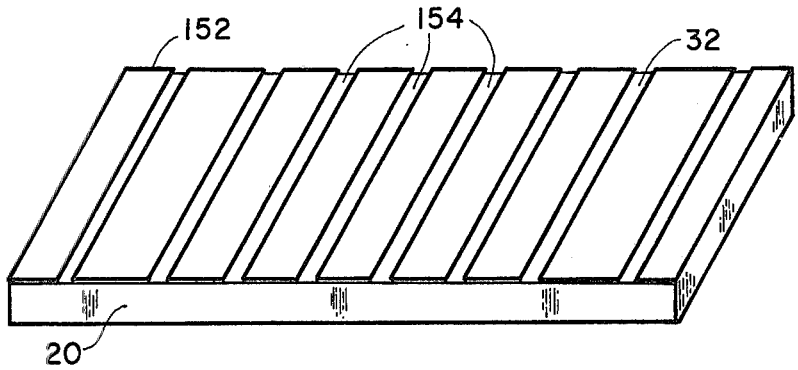
FIG. 3 is a perspective view of the base plate assembly of the display panel of the invention at one stage in its manufacture.
Figure 4:
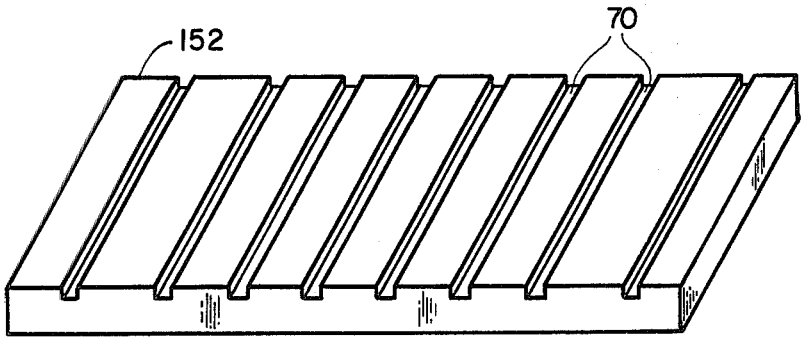
FIG. 4 is a view of the apparatus of FIG. 3 at a later stage in its preparation.
Figure 5:
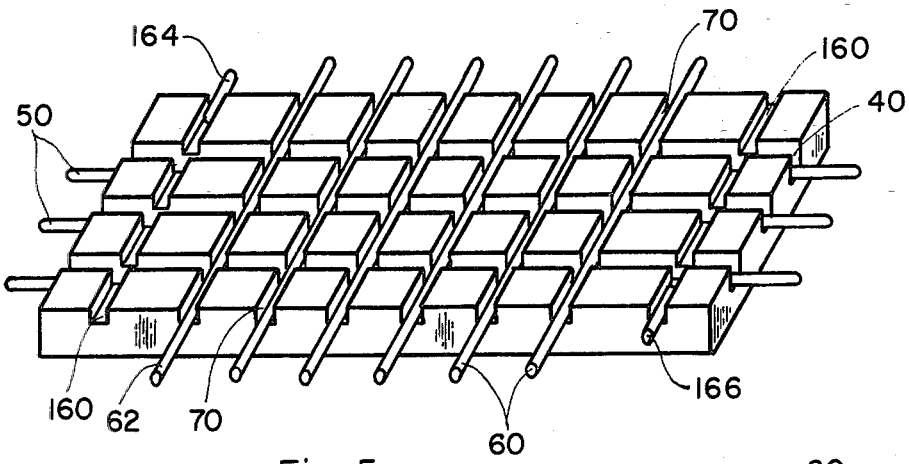
FIG. 5 is a perspective view of the apparatus of FIG. 4 at a later stage in its preparation.

According to the invention, the panel 10, or the base plate D.C. portion thereof, is made as follows: The glass plate 20 (FIG. 3), which is suitably cleaned and prepared, has its top surface 32 coated with an acid resist layer 152 in a pattern which leaves open, uncoated strips 154 on the surface of the plate. The coated plate 20 is fired, and then the glass surface in the uncoated strips is etched to provide the slots or grooves 70 (FIG. 4) where the open strips are present. The grooves 70 thus formed have the desired uniformity in depth, and, as an example in the type of panel described, they have a depth of 5½ mils and a width of 10 mils. A thin layer 168 of a vitreous dielectric is deposited in slots 70 and fired to provide means for securing the cathodes in place in a later operation. Next, the deeper, and less critical longitudinal anode slots 40 (FIG. 5) are formed and permissibly by a mechanical grooving process since the dimensions of these slots is not as critical as those of the cathode slots 70. In addition, two cross grooves 160, parallel to the cathode grooves 70, are formed at the ends of the baes plate, permissibly by mechanically grooving since they are not critical as to their dimensions.

The anode wires 50 of the panel 10, supported in a suitable harp, are set in place in the relatively deep longitudinal slots 40, and they are cemented in place by means of a suitable cement, such as Pyroceram or the like, placed across the plate at each end and in the cross grooves 160. In addition, short metal pins 164 and 166 are cemented in the cross grooves. One pin 164 protrudes from its groove 160 at the upper edge of the base plate, and the other pin 166 protrudes from its groove at the lower edge of the base plate.

Figure 6:
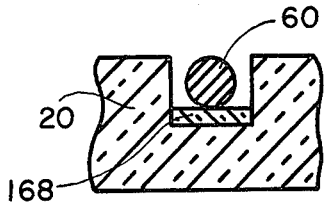
FIG. 6 is a sectional view of a portion of the apparatus shown in FIG. 5.
Figure 7:
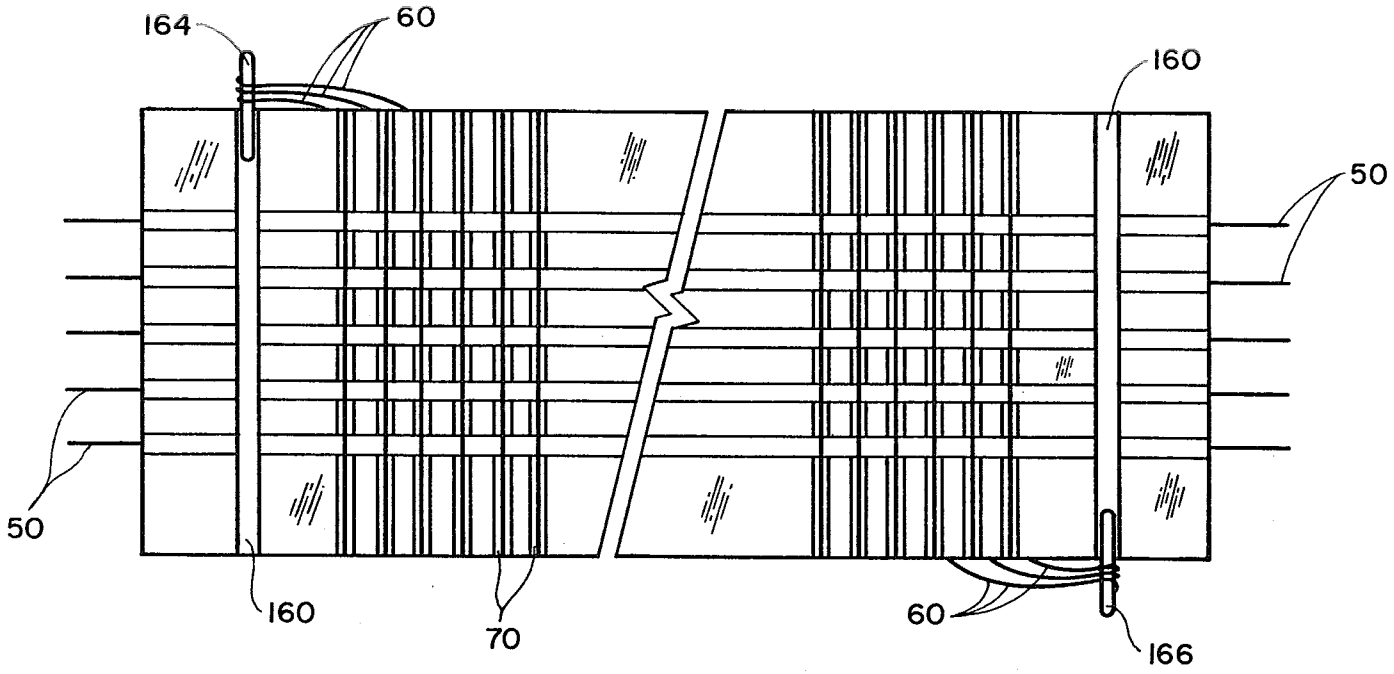
FIG. 7 is a plan view of a portion of the apparatus of FIG. 5.

Next, the cathodes 60, which are wires, are set in their slots 70 (FIG. 5), but preliminarily a thin layer of a vitreous dielectric 168 (FIG. 6) is provided in the slots 70 for securing the cathodes in place. This vitreous material is preferably one which has a melting temperature which is higher than the temperatures at which the panel is processed during manufacture. In one method, the cathodes are wound in multifilar fashion, with three, four, or other number of wires wound at the same time. To facilitate this operation, one end of each wire, before winding, is secured to the first pin 164, and, after the wires have been wound, the other ends of the wires are secured to the other pin 166. The base plate 20 is then heated to melt the vitreous dielectric 168 which, upon cooling, secures the cathode wires firmly and uniformly in place. The ends of the wires are then cut from the pins 164 and 166 to free them so that the desired electrical connections can be made.

Figure 8:
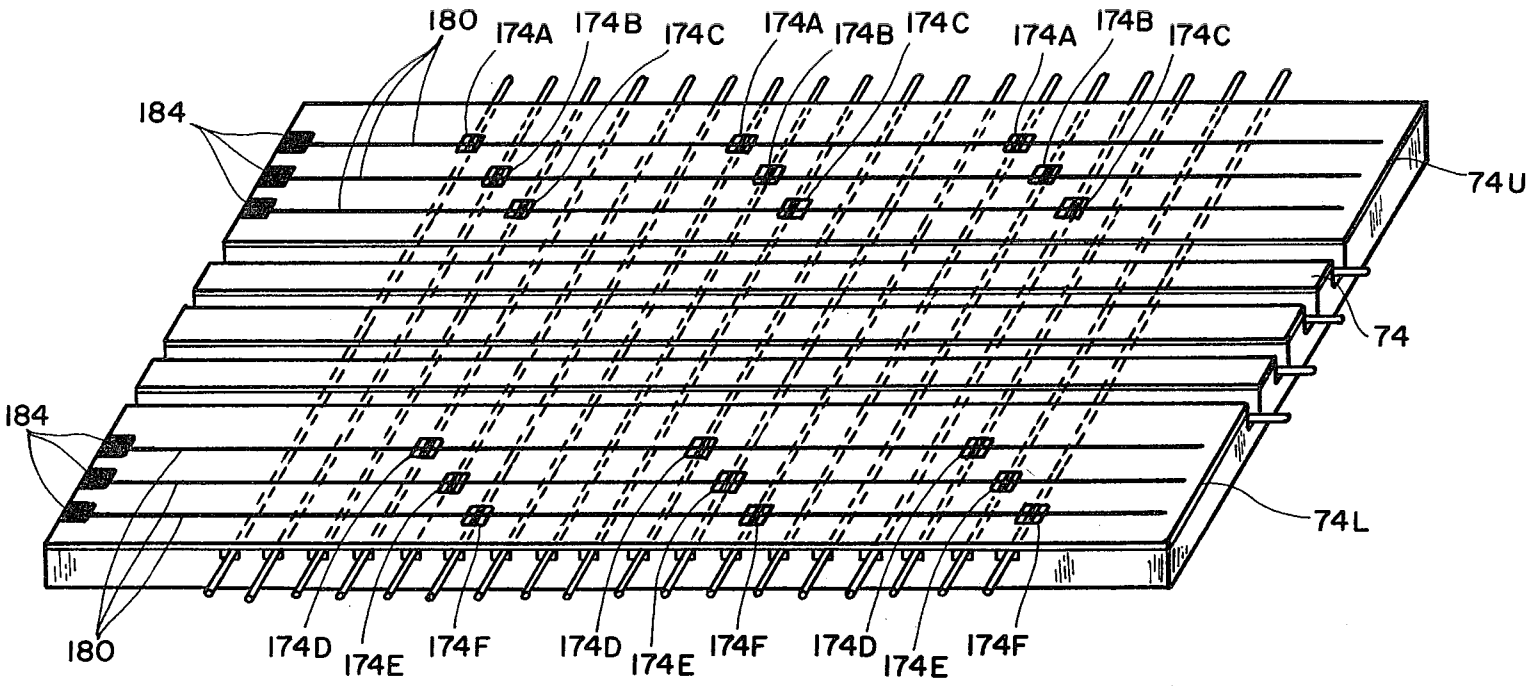
FIG. 8 is a perspective view of the base plate assembly of the display panel of the invention at still another stage in its preparation.

Next, referring to FIG. 8, insulating layer 74 is provided by a screening process or the like, with the portions of layer 74 adjacent to the upper and lower edges of the base plate, these portions being designated 74U and 74L. These portions of layer 74 are provided with small openings or vias 174 over the cathode wires 60 in slots 70 arrayed so that the cathodes can be electrically connected in groups.

If the cathodes are to be connected in a relatively large number of groups or phases, such as six, then the vias 174 are provided along both the upper and lower portions 74U and 74L, as shown in FIG. 8, with vias 174A, B, and C provided along the upper strip, and vias 174D, E, and F provided along the lower strip. The vias are properly offset so that vias 174A are aligned longitudinally, vias 174B are aligned, vias 174C are aligned, etc. In addition, vias 174A overlie and expose the first, seventh, thirteenth, etc. cathodes; vias 174B overlie and expose the second, eighth, fourteenth, etc. cathodes; and the other vias similarly overlie and expose a separte group of cathodes.

Conductive runs 180 of silver or the like are screened on the strips 74U and 74L and filling the vias 174 to contact the cathodes therein. There are three runs along the upper strip, one filling vias 174A, one filling vias 174B, and one filling vias 174C, and three along the lower strip, one filling vias 174D, one filling vias 174E, and one filling vias 174F. Each run 180 connects together the same corresponding cathode in the groups of cathodes. The conductive runs 180 extend to conductive pads 184 at the ends of the base plate on layer 74, whereby external electrical connection can be made thereto.

The other parts of the panel described above are then assembled with the base plate, and all are hermetically sealed together. The panel is evacuated, baked out, and filled with gas and suitably aged.

The operation of the panel 10 is not set forth in detail herein since it is described in detail in the above-mentioned applications. However, a brief description of the panel operation is as follows: With the keep-alive electrodes generating excited particles, and with operating potential applied to the scan anodes 50, the reset cathode 62 is energized to fire the column of reset cells, and then the scan cathodes 60 are energized sequentially to carry out a scanning operation in the lower portion of the panel. At the same time, with sustaining pulses applied between the electrodes 80 and 100, as each column of scan cells is energized, information or display signals are applied to the proper scan anodes 50 to cause glow to develop in the associated display cells 94 where it is sustained by the sustaining pulses. When all of the coluns of scan cells have been energized and the appropriate associated display cells have been energized, a sustained and visible message is present in the upper display portion of the panel.

It is noted that the principles of the invention may be used to provide a slotted plate and associated electrodes for use in other display panels than that described herein.

What is claimed is:

1. A display panel comprising a gas-filled envelope made up of a base plate and a viewing face plate hermetically sealed together, said envelope having a longitudinal axis, said base plate having a top surface, upper and lower edges lying parallel to said longitudinal axis, and left and right ends, a plurality of first parallel longitudinal slots formed in said top surface, an anode electrode seated in each of said slots and secured in place by a cement deposited in said slots, a plurality of second parallel slots formed in the top surface of said base plate and oriented generally transverse to said first slots, an insulating sealing material in each of said second slots and a cathode wire secured in place in each of said second slots by means of said sealing material, said cathodes being all substantially uniformly positioned depth-wise with respect to the top surface of said base plate, said cathodes being disposed transverse to and spaced from said anode wires, each crossing of an anode wire and a cathode wire defining a gas-filled cell, there being rows and columns of such cells, a layer of insulating material on said base plate and having marginal portions extending along the upper and lower edges of said base plate and overlying all of said cathodes, said layer of insulating material having a plurality of apertures in said marginal portions thereof, said apertures overlying selected ones of said cathodes adjacent to the longitudinal edges of said base plate, and longitudinal conductive runs on said marginal portions of said insulating layer, each conductive run making contact with different ones of said cathodes through said apertures whereby said cathodes are connected together in groups.

2. A display panel comprising a gas-filled envelope made up of a base plate and a viewing face plate hermetically sealed together, said envelope having a longitudinal axis, said base plate having a top surface, upper and lower edges lying parallel to said longitudinal axis, and left and right ends, a plurailty of first parallel longitudinal slots formed in said top surface, an anode electrode seated in each of said slots and secured in place by a cement deposited in said slots and near the ends of said slots, a plurality of second relatively shallow parallel slots in the top surface of said base plate and oriented generally transverse to said first slots, an insulating sealing material in each of said second slots and a cathode wire secured in place in each of said second slots by means of said sealing material, said cathodes being all substantially uniformly positioned depth-wise with respect to the top surface of said base plate, said cathodes being disposed transverse to and spaced from and lying above said anode wires, each crossing of an anode wire and a cathode wire defining a gas-filled priming or scanning cell, there being rows and columns of such scanning cells, a layer of insulating material on said base plate and having portions extending along the upper and lower edges of said base plate and overlying all of said cathodes, said layer of insulating material having a plurality of apertures in said marginal portions thereof, said apertures overlying selected ones of said cathodes adjacent to the longitudinal edges of said base plate, and longitudinal conductive runs on said marginal portions of said insulating layer, each conductive run making contact with different ones of said cathodes through said apertures whereby said cathodes are connected together in groups.

3. A display panel comprising a gas-filled envelope made up of a base plate and a viewing face plate hermetically sealed together, said envelope having a longitudinal axis, said base plate having a top surface, upper and lower edges lying parallel to said longitudinal axis, and left and right ends, a plurality of first relatively deep parallel longitudinal slots formed in said top surface, an anode electrode seated in each of said slots and secured in place by a cement deposited in said slots, near the ends of said slots, two cross-grooves in the top surface of the base plate at the ends of said base plate, said cross grooves being oriented transverse to said first slots and filled with a cement which also secures said anode electrodes in place, a plurality of second relatively shallow parallel slots in the top surface of said base plate and oriented generally transverse to said first slots, an insulating sealing material in each of said second slots and a cathode wire secured in place in each of said second slots by means of said sealing material, said cathodes being all substantially uniformly positioned depth-wise with respect to the top surface of said base plate, said cathodes being disposed transverse to and spaced from and above said anode wires, each crossing of an anode wire and a cathode wire defining a priming or scanning cell, there being rows and columns of such scanning cells, a layer of insulating material on said base plate and having portions extending along the upper and lower edges of said base plate and overlying all of said cathodes, said layer of insulating material having a plurality of apertures in said portions thereof, said apertures overlying selected ones of said cathodes adjacent to the longitudinal edges of said base plate, conductive runs on said portions of said insulating layer, each run making contact with different ones of said cathodes through said apertures whereby said cathodes are connected in groups, and an array of display cells disposed above said scanning cells adjacent to said face plate, said display cells being in gas communication with said scanning cells.

* * * * *